US008342873B2

(12) United States Patent
Liao et al.

(10) Patent No.: US 8,342,873 B2
(45) Date of Patent: Jan. 1, 2013

(54) ELECTRICAL SOCKET HAVING SUITABLE RECEIVING SPACE FOR A SOLDER BALL OF AN IC PACKAGE

(75) Inventors: Fang-Jwu Liao, New Taipei (TW); Ke-Hao Chen, New Taipei (TW); Chun-Fu Lin, New Taipei (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/213,105

(22) Filed: Aug. 19, 2011

(65) Prior Publication Data

US 2012/0045946 A1 Feb. 23, 2012

(51) Int. Cl.
*H01R 13/625* (2006.01)

(52) U.S. Cl. ..... 439/342

(58) Field of Classification Search ..... 439/342, 439/70–74, 83

See application file for complete search history.

(56) References Cited

U.S. PATENT DOCUMENTS 5,573,435 A 11/1996 Grabbe et al.
5,730,606 A 3/1998 Sinclair
5,984,694 A * 11/1999 Sinclair ..... 439/70
6,554,634 B1 * 4/2003 Lin et al. ..... 439/342
6,572,386 B1 * 6/2003 Howell et al. ..... 439/66
6,881,075 B2 * 4/2005 Huang et al. ..... 439/74
7,137,841 B1 * 11/2006 Liao et al. ..... 439/342
7,484,985 B2 * 2/2009 Wang et al. ..... 439/342
7,780,456 B2 * 8/2010 Chen et al. ..... 439/66
2007/0026719 A1 * 2/2007 Liao ..... 439/342
2009/0263985 A1 * 10/2009 Liu et al. ..... 439/66

* cited by examiner

*Primary Examiner* — Chandrika Prasad

(74) *Attorney, Agent, or Firm* — Wei Te Chung; Ming Chieh Chang

(57) ABSTRACT

An electrical socket used to connecting an IC package to a printed circuit board comprises an insulative housing (2) and a plurality of contacts (1) received therein, the insulative housing (2) comprises a top surface (21), a bottom surface (22) opposite to the top surface (21) and a plurality of passageways (211) penetrated the top surface (21) and the bottom surface (22), the contact (1) comprises a body portion (10), a connecting portion (11) extending upwardly from the body portion (10) and a spring portion (12) extending horizontally from the connecting portion (11), the spring portion (12) comprises a supporting portion (120) at the end thereof touching with the insulative housing (2).

14 Claims, 7 Drawing Sheets

ELECTRICAL SOCKET HAVING SUITABLE RECEIVING SPACE FOR A SOLDER BALL OF AN IC PACKAGE

BACKGROUND OF THE INVENTION

1. Field of the Invention

The present invention relates to a socket connector, and more particularly to a socket connector having arrangement to receive solder lead from IC package.

2. Description of the Prior Art

A typical electrical connector electrically connecting an BGA typed IC package to a printed circuit board is described in U.S. Pat. No. 5,573,435, issued to Grabbe on Nov. 12, 1996. The electrical connector comprises an insulative housing and a plurality of contacts received therein. The insulative housing comprises a bottom wall and a plurality of passageways penetrates the bottom wall. The contacts are arranged in the passageways respectively and each comprises a body portion, an upper contact portion extending upwardly and a lower contact portion extending downwardly. When a force is exerted on the upper contact portion, the body portion is distorted to make a reliable electrical connection between the IC package and the contact.

Due to the electrical connector becomes smaller and smaller and the number of the contacts becomes more and more. The solder balls of the IC package are disengaged from the contacts easily, which affects the connection quality between the IC package and the electrical connector.

Therefore, it is needed to find a new electrical socket to overcome the problems mentioned above.

SUMMARY OF THE INVENTION

Accordingly, an object of the present invention is to provide an electrical socket having improved contacts making the solder balls of the IC package touched the contacts securely.

In order to achieve the object set forth, an electrical socket used to connecting an IC package to a printed circuit board comprises an insulative housing and a plurality of contacts received therein, the insulative housing comprises a top surface, a bottom surface opposite to the top surface and a plurality of passageways penetrated the top surface and the bottom surface, the contact comprises a body portion, a connecting portion extending upwardly from the body portion and a spring portion extending horizontally from the connecting portion, the spring portion comprises a supporting portion at the end thereof touching with the insulative housing.

DESCRIPTION OF PREFERRED EMBODIMENT

Reference will now be made to the drawings to describe the present invention in detail.

Figure 1:
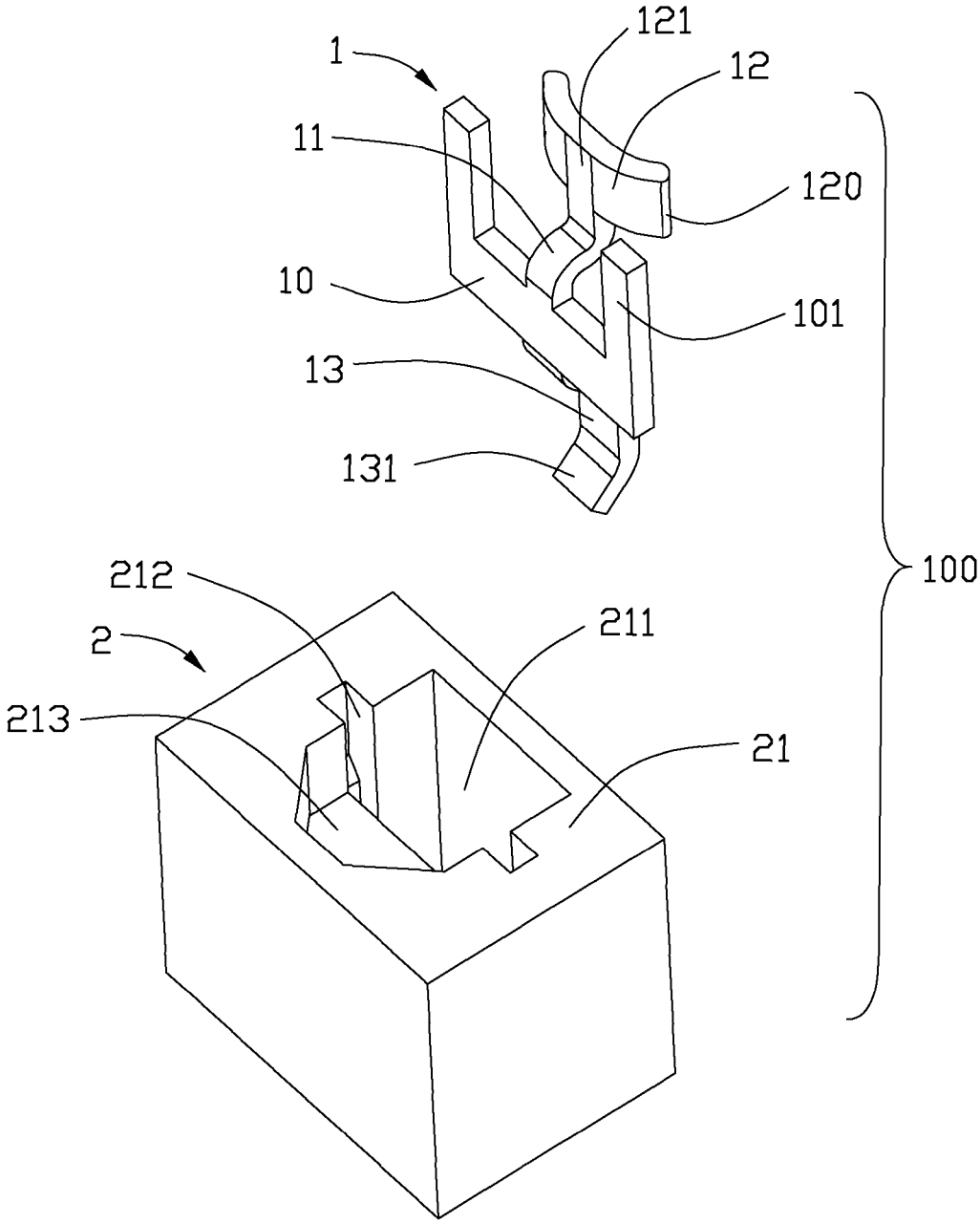
FIG. 1 is an exploded view of the electrical socket according to a preferred embodiment of the present invention.
Figure 2:
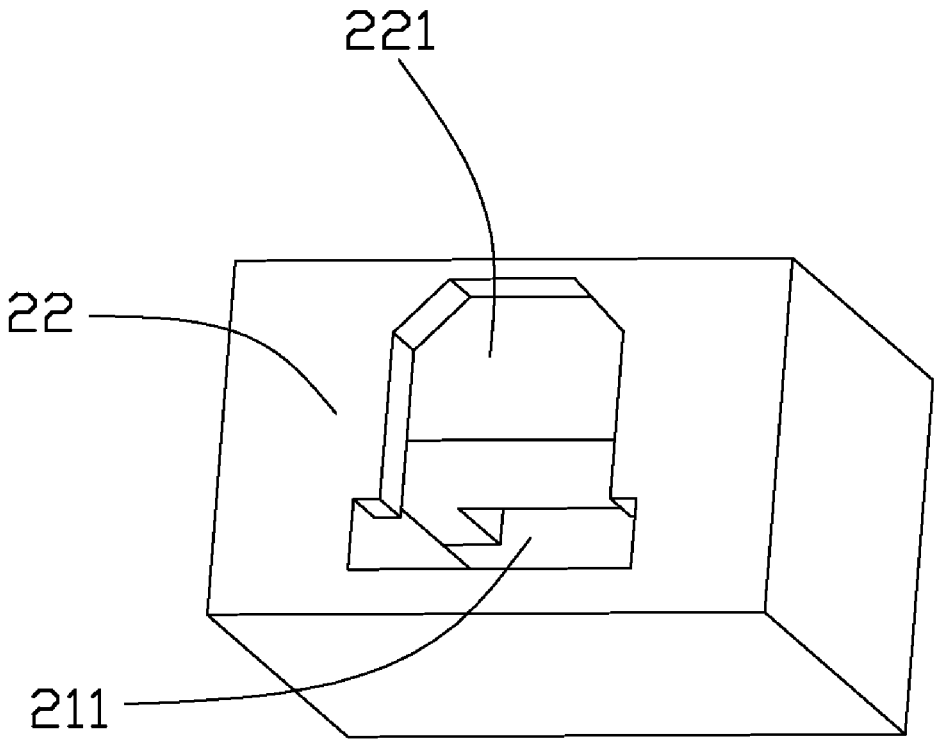
FIG. 2 is an isometric view of the insulative housing shown in FIG. 1.

Referring to FIGS. 1-2, an electrical socket 100 according to the prevent invention comprises an insulative housing 2, a plurality of electrical contacts 1 received therein and a plurality of solder balls 5 received in the insulative housing 2 and hooked by the contacts 1.

The insulative housing 2 comprises a top surface 21, a bottom surface 22 opposite to the top surface 21 and a plurality of passageways 211 penetrate the top surface 21 and the bottom surface 22. The insulative housing 1 also comprises a pair of retention recesses 212 and a first receiving space 213 recessed from the top surface 21, and a second receiving space 221 recessed from the bottom surface 22 to the interior of the insulative housing 1. The retention recess 212 the first receiving space 213 and the second receiving space 221 communicate with the passageway 211.

The contact 1 comprises a body portion 10, a connecting portion 11 extending upwardly from the middle of the body portion 10, an spring portion 12 extending horizontally from the top of the connecting portion 11 and a tail portion 13 extending downwardly from the body portion 10. The contact 1 also comprises a pair of retention portions 11 extending upwardly from the two ends of the body portion 10. The spring portion 12 is configured to an arc shape and comprises a contact portion 121 on the middle thereof and a pair of support portions 120 at the two ends thereof. The tail portion 13 comprises a hook 131 at the end thereof.

Figure 3:
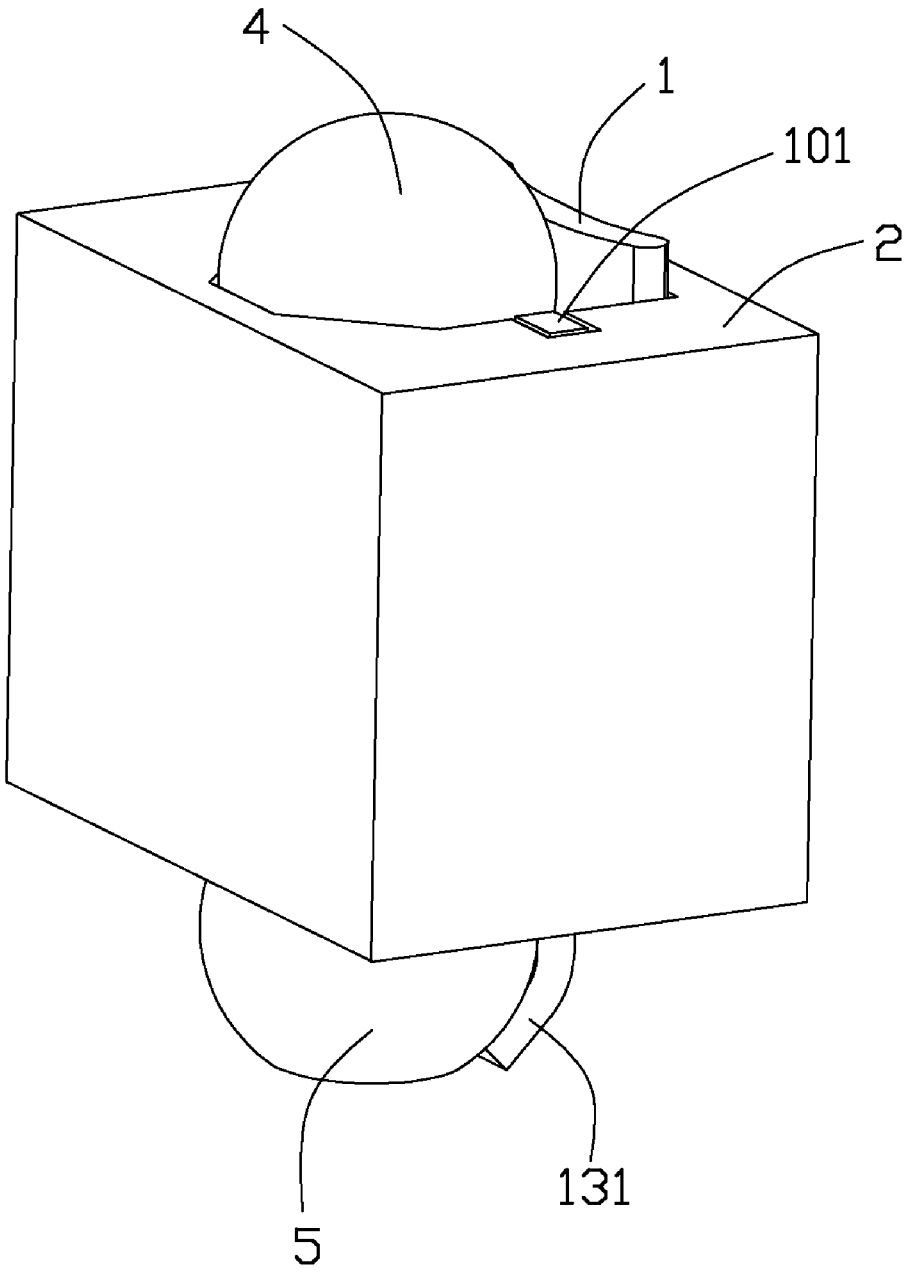
FIG. 3 is an assembled view of the electrical socket shown in FIG. 1, and a solder ball of an IC package is arranged on the electrical socket.
Figure 4:
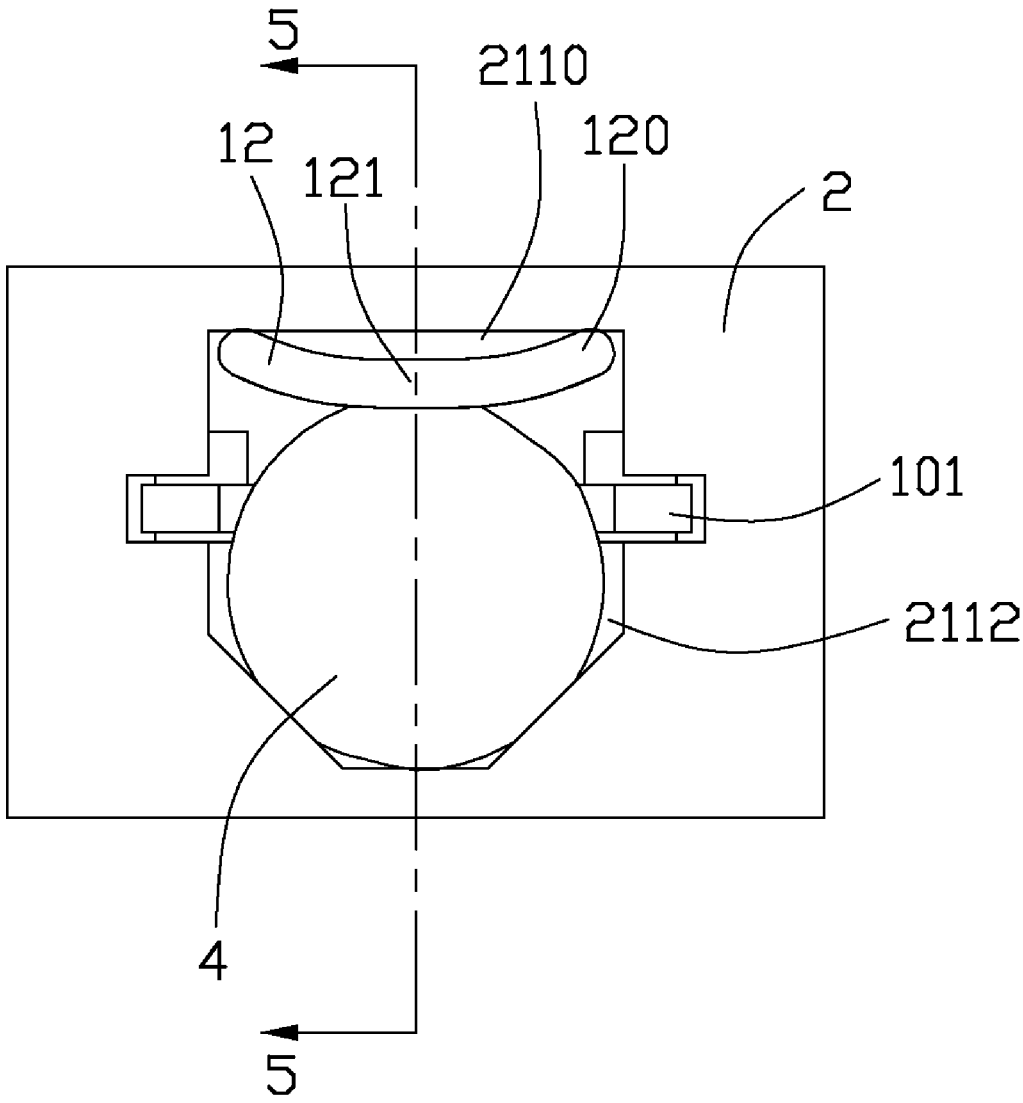
FIG. 4 is a top view of the electrical socket shown in FIG. 3.
Figure 5:
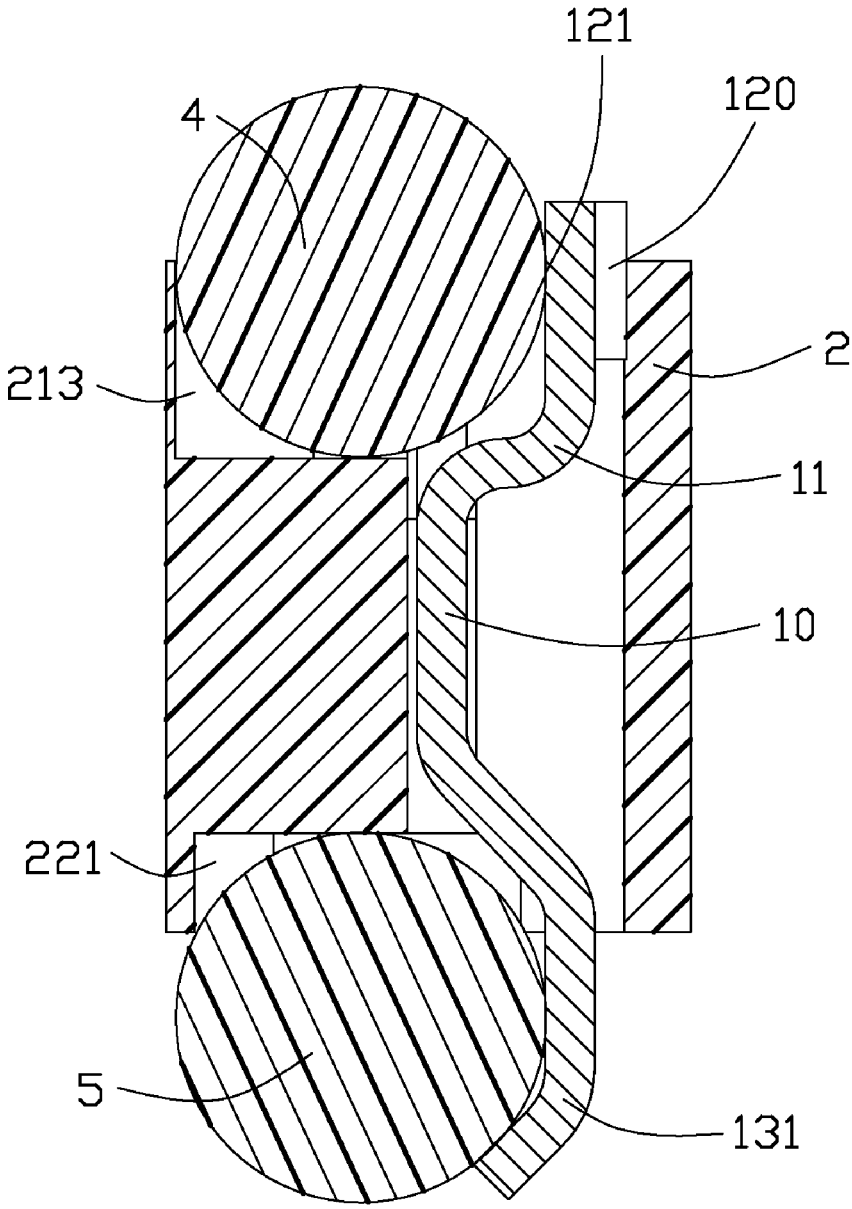
FIG. 5 is a cross-sectional view of the electrical socket taken along line 5-5 in FIG. 4.

FIGS. 3-5 show an assembled view of the electrical socket 100. The contacts 1 are received in the passageways 211. The retention portions 11 are received in the retention recesses 212 respectively to position the contact 1 in the insulative housing 2. The support portions 120 of the spring portion 12 touches with the insulative housing 2 and the passageway 211 is divided into a first space 2112 and a second space 2110 by the spring portion 12, the first space 2112 is used to receive the ball 4 of the IC package. The solder ball 5 is received in the second receiving space 221 and cradled by the hook 131 of the contact 1.

The first space 2112 is smaller than the ball 4 of the IC package. When the IC package is assembled to the electrical socket 100, the ball 4 of the IC package locates in the first receiving space 213 and exerts a force on the spring portion 12 to make the spring portion 12 deformed to enter into the second space 2110. Thus, the ball 4 is securely received between the spring portion 12 and the insulative housing 2. Due to the support portions 120 of the spring portion 12 touches with the insulative housing 2, the spring portion 120 has a reliable elasticity to engage with the ball 4 tightly.

Figure 6:
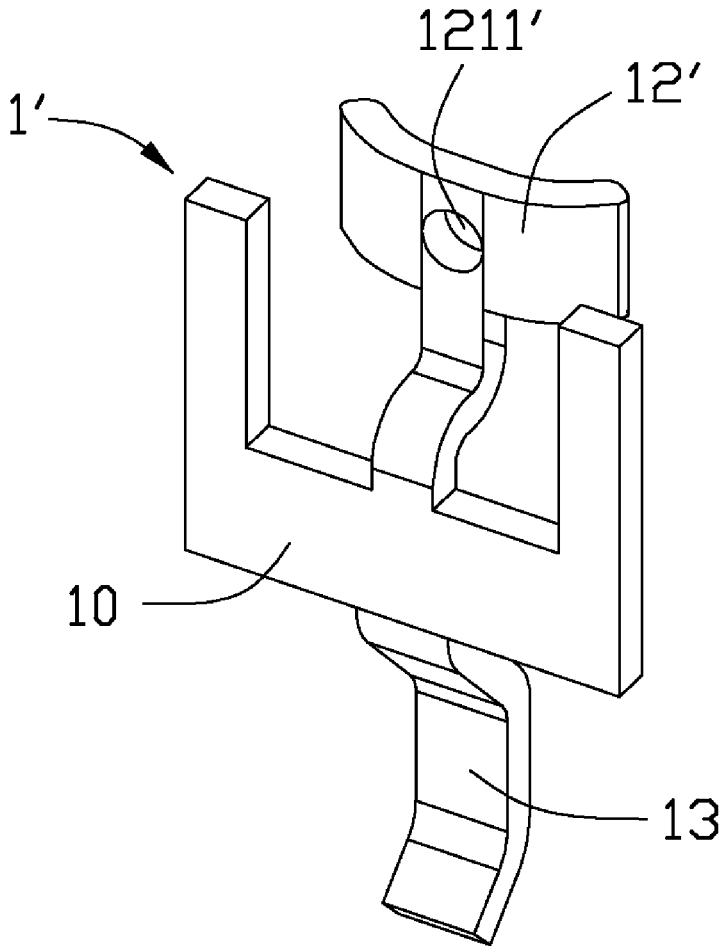
FIG. 6 is a second embodiment of the electrical contact shown in FIG. 1.
Figure 7:
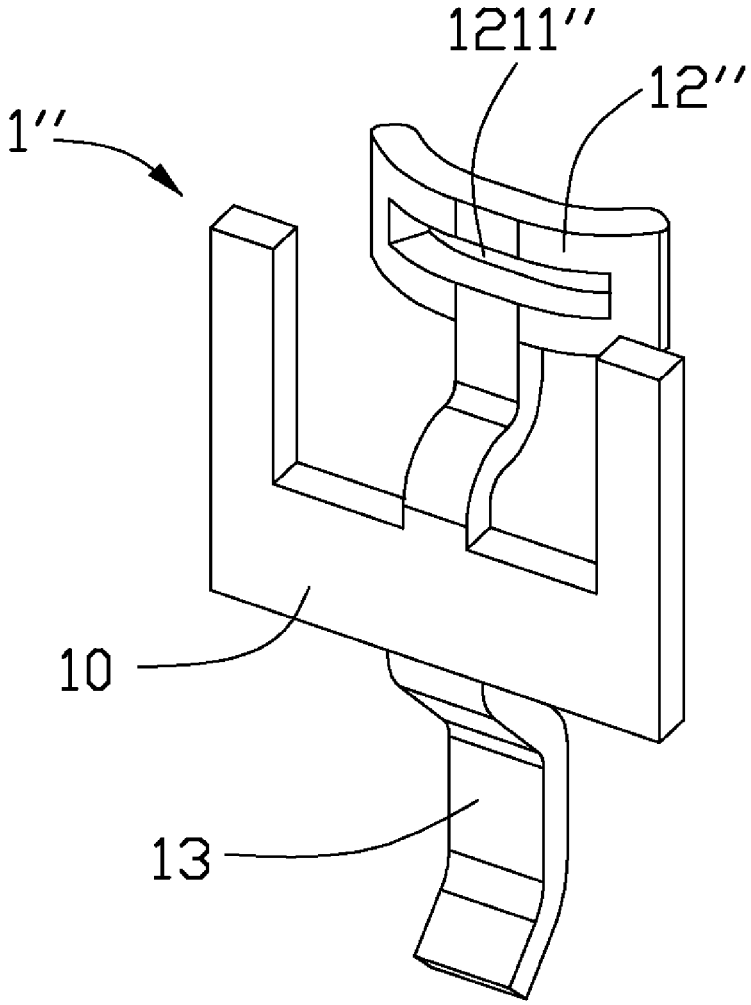
FIG. 7 is a third embodiment of the electrical contact shown in FIG. 1.

FIGS. 6-7 show another two embodiment of the electrical contact 1'. The difference with the above embodiment is that a circular hole 1211' is defined in the spring portion 12' as shown in FIG. 5 and there is a elongated hole 1211" on the spring portion 12" shown in FIG. 6. The hole 1211', 1211" makes the spring portion 12', 12" exert a good retention force to the ball 4 of the IC package.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical socket used to connecting an IC package to a printed circuit board, comprising:

an insulative housing comprising a top surface, a bottom surface opposite to the top surface and a plurality of passageways penetrated the top surface and the bottom surface; and a plurality of contacts received in the passageways of the insulative housing and comprising a body portion, a connecting portion extending upwardly from the body portion and a spring portion extending horizontally from the connecting portion;

wherein the spring portion comprises a supporting portion at the end thereof for touching with the insulative housing and the spring portion comprises a contact portion contacting a ball of the IC package and there is a hole in the contact portion.

2. The electrical socket as claimed in claim 1, wherein the insulative housing comprises a plurality of first receiving spaces recessed from the top surface and communicated with the passageways respectively.

3. The electrical socket as claimed in claim 2, wherein the first receiving space is used to receive the ball of the IC package and each of the first receiving spaces has a volume smaller than that of the ball.

4. The electrical socket as claimed in claim 1, wherein the contact comprises a tail portion extending downwardly from the body portion.

5. The electrical socket as claimed in claim 4, wherein the tail portion comprises a hook at the end thereof and a solder ball is cradled by the hook.

6. The electrical socket as claimed in claim 5, wherein the insulative housing comprises a plurality of second receiving spaces recessed from the bottom surface and the solder ball is received in the second receiving space.

7. The electrical socket as claimed in claim 1, wherein the contact comprises a pair of retention portions extending upwardly from the two ends of the body portion, the insulative housing comprises a pair of retention recesses for receiving the retention portions.

8. An electrical socket used to connecting an IC package to a printed circuit board, comprising:

an insulative housing comprising a top surface, a bottom surface opposite to the top surface, a plurality of passageways penetrated the top surface and the bottom surface; and a plurality of contacts received in the passageways of the insulative housing and comprising a body portion, a connecting portion extending upwardly from the body portion and a spring portion extending horizontally from the connecting portion;

wherein the spring portion comprises a supporting portion at the end thereof for touching with the insulative housing, the passageway is divided into a first space and a second space by the spring portion, the first space is used to receive a ball of the IC package and the ball exert a force on the spring portion to push the spring portion moving to the second space.

9. The electrical socket as claimed in claim 8, wherein the insulative housing comprises a plurality of first receiving spaces recessed from the top surface and communicated with the passageways respectively.

10. The electrical socket as claimed in claim 9, wherein the first receiving space is used to receive the ball of the IC package and each of the first receiving spaces has a volume smaller than that of the ball.

11. The electrical socket as claimed in claim 8, wherein the contact comprises a tail portion extending downwardly from the body portion.

12. The electrical socket as claimed in claim 11, wherein the tail portion comprises a hook at the end thereof and a solder ball is cradled by the hook.

13. The electrical socket as claimed in claim 12, wherein the insulative housing comprises a plurality of second receiving spaces recessed from the bottom surface and a solder ball is received in the second receiving space.

14. The electrical socket as claimed in claim 8, wherein the contact comprises a pair of retention portions extending upwardly from the two ends of the body portion, the insulative housing comprises a pair of retention recesses for receiving the retention portions.

* * * * *